US009405242B2

(12) United States Patent
Hase et al.

(10) Patent No.: US 9,405,242 B2
(45) Date of Patent: Aug. 2, 2016

(54) FIXING DEVICE AND IMAGE FORMING DEVICE

(71) Applicants: Takamasa Hase, Shizuoka (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Takeshi Uchitani, Kanagawa (JP); Shuutaroh Yuasa, Kanagawa (JP); Masaaki Yoshikawa, Tokyo (JP); Hiroshi Yoshinaga, Chiba (JP); Hiromasa Takagi, Tokyo (JP); Naoki Iwaya, Tokyo (JP); Takahiro Imada, Kanagawa (JP); Hajime Gotoh, Kanagawa (JP); Takuya Seshita, Kanagawa (JP); Ryota Yamashina, Kanagawa (JP); Yasunori Ishigaya, Kanagawa (JP)

(72) Inventors: Takamasa Hase, Shizuoka (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Takeshi Uchitani, Kanagawa (JP); Shuutaroh Yuasa, Kanagawa (JP); Masaaki Yoshikawa, Tokyo (JP); Hiroshi Yoshinaga, Chiba (JP); Hiromasa Takagi, Tokyo (JP); Naoki Iwaya, Tokyo (JP); Takahiro Imada, Kanagawa (JP); Hajime Gotoh, Kanagawa (JP); Takuya Seshita, Kanagawa (JP); Ryota Yamashina, Kanagawa (JP); Yasunori Ishigaya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/703,508

(22) Filed: May 4, 2015

(65) Prior Publication Data

US 2015/0234329 A1 Aug. 20, 2015

Related U.S. Application Data

(63) Continuation of application No. 13/754,305, filed on Jan. 30, 2013, now Pat. No. 9,031,439.

(30) Foreign Application Priority Data

Jan. 31, 2012 (JP) ..... 2012-018562
Nov. 8, 2012 (JP) ..... 2012-246308

(51) Int. Cl.
*G03G 15/20* (2006.01)

(52) U.S. Cl.
CPC ..... *G03G 15/2039* (2013.01)

(58) Field of Classification Search
CPC . G03G 15/2039; G03G 15/205; G03G 15/80; G03G 2215/2035
USPC ..... 399/33, 67, 69, 94, 122
See application file for complete search history.

(56) References Cited

U.S. PATENT DOCUMENTS 5,436,709 A * 7/1995 Sakaizawa ..... G03G 15/2039 219/216
7,199,335 B2 4/2007 Takami et al.

(Continued)

FOREIGN PATENT DOCUMENTS

JP 03-015884 A 1/1991
JP 2001-056622 2/2001

(Continued)

*Primary Examiner* — Francis Gray
(74) *Attorney, Agent, or Firm* — Oblon, McClelland, Maier & Neustadt, L.L.P

(57) ABSTRACT

According to an embodiment, provided is a fixing device that includes: a rotatable fixing member that heats a recording medium on a side carrying an unfixed image; a rotatable pressing member that is pressed and is contacted with the fixing member to form a nip portion between the pressing member and the fixing member; a heat source heating the fixing member; a relay switch provided in an energizing path for the heat source; a temperature detection sensor detecting a temperature of the fixing member; and a control unit that controls energization of the heat source according to the temperature detected by the temperature detection sensor. The control unit keeps the relay switch in an off state if the temperature of the fixing member is equal to or more than a predetermined temperature when the fixing member has stopped rotation.

27 Claims, 7 Drawing Sheets

(56) References Cited

U.S. PATENT DOCUMENTS

| | | | | |
|---|---|---|---|---|
| 8,139,963 | B2 * | 3/2012 | Takami | 399/33 |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0123315 | A1 | 6/2005 | Kishi et al. | |
| 2005/0139584 | A1 | 6/2005 | Kishi et al. | |
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2006/0182460 | A1 | 8/2006 | Kishi et al. | |
| 2007/0025754 | A1 * | 2/2007 | Takagi | G03G 15/2039 399/88 |
| 2007/0031159 | A1 | 2/2007 | Kishi et al. | |
| 2007/0059012 | A1 | 3/2007 | Tomine et al. | |
| 2007/0292175 | A1 | 12/2007 | Shinshi | |
| 2008/0056751 | A1 * | 3/2008 | Murata | G03G 15/5004 399/70 |
| 2008/0124147 | A1 | 5/2008 | Uehara et al. | |
| 2008/0145088 | A1 | 6/2008 | Matsusaka et al. | |
| 2009/0202269 | A1 | 8/2009 | Tomine et al. | |
| 2009/0297199 | A1 | 12/2009 | Yamashina et al. | |
| 2010/0046973 | A1 * | 2/2010 | Hachisuka | 399/69 |
| 2010/0061754 | A1 * | 3/2010 | Ishigaya | G03G 15/2039 399/70 |
| 2010/0067929 | A1 | 3/2010 | Seki | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206402 | A1 | 8/2011 | Yamashina | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222927 | A1 | 9/2011 | Yamashina | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0268460 | A1 * | 11/2011 | Odate | 399/33 |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0299899 | A1 | 12/2011 | Ishigaya et al. | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093532 | A1 | 4/2012 | Ishigaya et al. | |
| 2012/0093534 | A1 | 4/2012 | Waida et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148287 | A1 | 6/2012 | Samei et al. | |
| 2012/0148303 | A1 | 6/2012 | Yamaguchi et al. | |
| 2012/0148317 | A1 | 6/2012 | Samei et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 * | 7/2012 | Ikebuchi et al. | 399/69 |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0201547 | A1 | 8/2012 | Yamashina | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2012/0243895 | A1 | 9/2012 | Samei et al. | |
| 2013/0045032 | A1 | 2/2013 | Shimokawa et al. | |
| 2013/0051876 | A1 | 2/2013 | Ishigaya et al. | |
| 2013/0136479 | A1 | 5/2013 | Yuasa et al. | |
| 2013/0209124 | A1 | 8/2013 | Saito et al. | |

FOREIGN PATENT DOCUMENTS

| | | |
|---|---|---|
| JP | 2005-037539 | 2/2005 |
| JP | 2007-079040 | 3/2007 |
| JP | 2007-334205 | 12/2007 |
| JP | 2008-065002 | 3/2008 |
| JP | 2008-129517 | 6/2008 |
| JP | 2010-032625 | 2/2010 |
| JP | 2010-066376 | 3/2010 |
| JP | 2010-066583 | 3/2010 |
| JP | 4875385 | 12/2011 |

* cited by examiner

FIXING DEVICE AND IMAGE FORMING DEVICE

CROSS-REFERENCE TO RELATED APPLICATIONS

This application is a continuation application of U.S. application Ser. No. 13/754,305, filed on Jan. 30, 2013, which claims priority to and incorporates by reference the entire contents of Japanese Patent Application No. 2012-018562 filed in Japan on Jan. 31, 2012 and Japanese Patent Application No. 2012-246308 filed in Japan on Nov. 8, 2012.

BACKGROUND OF THE INVENTION

1. Field of the Invention

The present invention relates to a fixing device configured to fix an image onto a recording medium, and an image forming device including the fixing device.

2. Description of the Related Art

In various kinds of image forming devices such as photocopiers, printers, facsimiles, or MFPs of the foregoing devices, copies and records can be obtained by heating an unfixed image transferred to and carried on a recording medium such as paper so as to fix the image to the recording medium.

On fixation, the unfixed image is heated while the recording medium carrying the unfixed image is sandwiched and conveyed by a fixing member and a pressing member, thereby to fuse and soften a developer, in particular toner, contained in the unfixed image so as to penetrate the recording medium. Accordingly, the toner is fixed onto the recording medium.

When the fixing member is heated by a heat source to a predetermined temperature, if heating time until the predetermined temperature is reached is sufficiently short, it is possible to reduce significantly energy consumption without exerting great influence on ease of use even if a pre-heat process is eliminated in a stand-by state. To achieve the advantage, the fixing member is formed by low-heat capacity members or the like, such as a thin-walled roller and a thin-walled belt made of a metallic base material and an elastic rubber layer. In addition, the heat source is formed by a halogen heater heating the fixing member by radiation heat, a ceramic heater, an IH system with high heating efficiency, or the like, for realization of rapid heating. The fixing devices having these components are disclosed in Japanese Patent Application Laid-open No. 2007-79040, Japanese Patent Application Laid-open No. 2010-32625, Japanese Patent Application Laid-open No. 2007-334205 and Japanese Patent Application Laid-open No. 2008-129517, for example.

In the foregoing fixing devices, at execution of an image fixing operation, heat from the fixing member and the pressing member is absorbed by a recording medium, for example paper, passing through a nip portion between the two members; and thus the temperatures of the fixing member and the pressing member do not become abnormally high. However, when the fixing member and the pressing member do not rotate at a sudden stop of the image forming device due to occurrence of a paper jam or other events, during power-off of the image forming device, in a stand-by mode, in a low-power mode, or the like, a portion of the fixing member neighboring the heat source may be locally heated and excessively raised in temperature by residual heat of the heat source even if power supply to the heat source is stopped. In particular, if the fixing device includes the fixing member that is made lower in heat capacity by decreasing the wall thickness or the like for the purposes of shortening of a warm-up time and reduction of energy consumption, the fixing member tends to be excessively raised in temperature.

Meanwhile, these fixing devices are configured such that, if a temperature detection unit detects an excessive rise in temperature of the fixing member, an overheat protection circuit is activated to determine this state as abnormal; shut off power supply to the heat source; and stops rotation of the fixing member and the pressing member, thereby bringing the image forming device to an abnormal stop. In general, it is hard for a user to recover the image forming device from the abnormal stop made by the overheat protection circuit; and thus the user needs to ask technical personnel or the like from a device manufacturer to conduct a recovery operation. Accordingly, if the image forming device is brought into an abnormal stop by the overheat protection circuit, it takes a relatively large amount of time to complete a recovery operation and allow the image forming device to be operable again. The time is so-called "down time."

For the reasons described above, the fixing member may be excessively raised in temperature within a predetermined period of time from a sudden stop or power-off of the image forming device due to occurrence of a paper jam or the like or from shift of the image forming device to the stand-by mode or the low-power mode or the like. Accordingly, if the image forming device is restarted within the foregoing predetermined period of time from a sudden stop or power-off of the image forming device, the temperature detection unit may detect an temporary excessive rise in temperature of the fixing member; and the overheat protection circuit may misjudge this state as abnormal and may stop again the image forming device. Similarly, the temperature detection unit may detect a temporary excessive rise in temperature of the fixing member within the predetermined period of time from shift of the image forming device to the stand-by mode or the low-power mode or the like, and the overheat protection circuit may misjudge this state as abnormal and stop the image forming device. In this case, there is a problem that the "down time" becomes relatively long until the image forming device becomes operable again.

There is a need to provide a fixing device that, when an image forming device is restarted after a sudden stop or power-off due to occurrence of a paper jam or the like, or when the image forming device shifts to a stand-by mode or a low-power mode or the like, can re-start operation or continue a predetermined mode safely and appropriately, without causing an abnormal stop due to misjudgment of the overheat protection circuit or the like, and an image forming device including the fixing device.

SUMMARY OF THE INVENTION

It is an object of the present invention to at least partially solve the problems in the conventional technology.

According to an embodiment, provided is a fixing device that includes: a rotatable fixing member that heats a recording medium on a side carrying an unfixed image; a rotatable pressing member that is pressed and is contacted with the fixing member to form a nip portion between the pressing member and the fixing member; a heat source heating the fixing member; a relay switch provided in an energizing path for the heat source; a temperature detection sensor detecting a temperature of the fixing member; and a control unit that controls energization of the heat source according to the temperature detected by the temperature detection sensor.

The control unit keeps the relay switch in an off state if the temperature of the fixing member is equal to or more than a predetermined temperature when the fixing member has stopped rotation.

According to another embodiment, provided is an image forming device that includes the fixing device described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
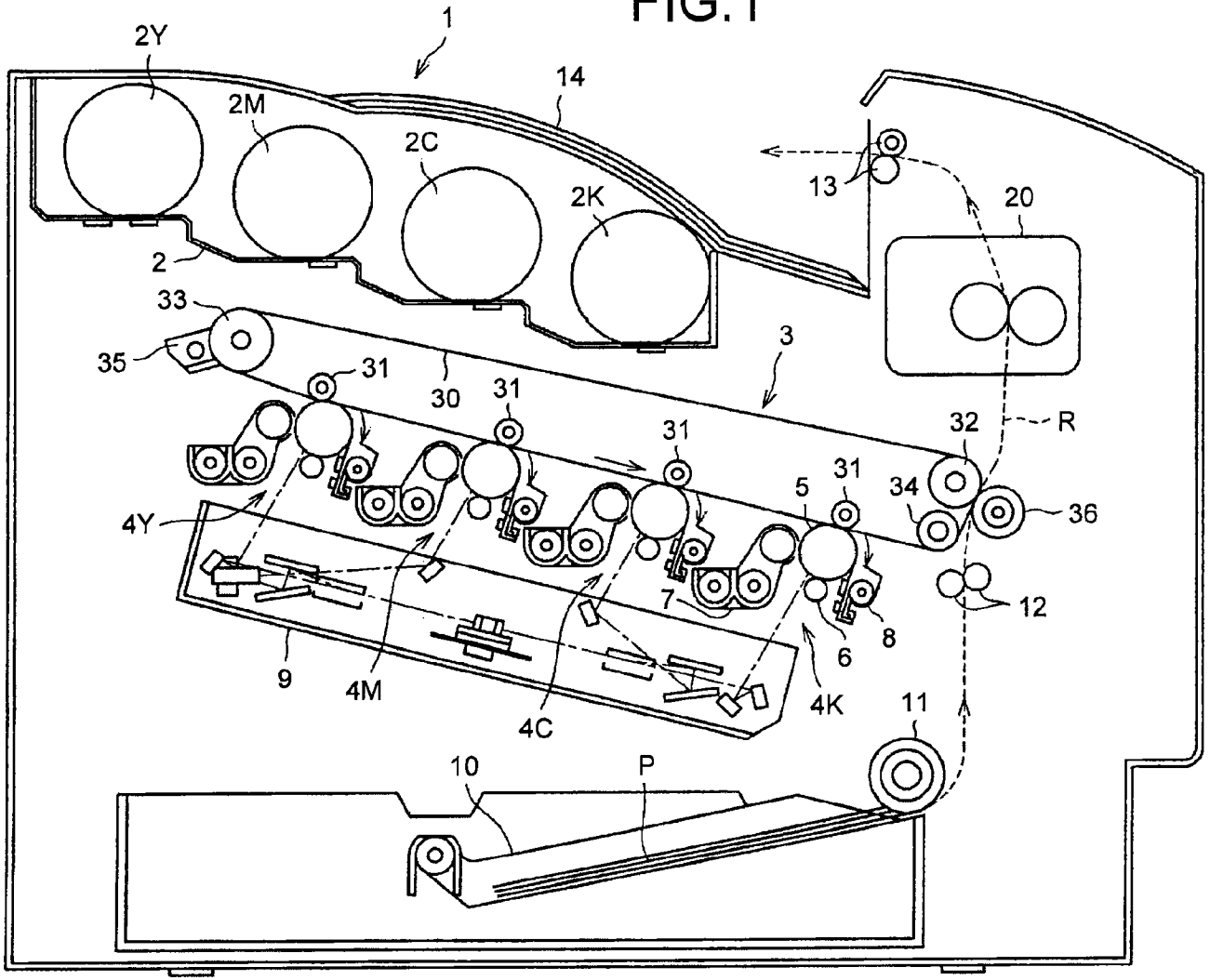
FIG. 1 is a schematic configuration diagram of one embodiment of an image forming device.

With reference to the attached drawings, an embodiment will be described below. In each of the drawings describing the embodiment, constitutional elements such as members and components identical in functionality or shape are given the same reference numerals as far as these elements can be identified as identical, and the elements will be described herein only once.

First, referring to FIG. 1, an entire configuration and operation of the image forming device according to the embodiment will be described.

An image forming device 1 illustrated in FIG. 1 is a tandem color laser printer that has four image forming units 4Y, 4M, 4C, and 4K on a center of a device main body. The image forming units 4Y, 4M, 4C, and 4K are identical in configuration except for storing developers of different colors of yellow (Y), magenta (M), cyan (C), and black (K) corresponding to color separation components of color images.

Specifically, each of the image forming units 4Y, 4M, 4C, and 4K includes a drum-shaped photosensitive element 5 as a latent image carrier, a charging device 6 that charges a surface of the photosensitive element 5, a developing device 7 that supplies toner to the surface of the photosensitive element 5, a cleaning device 8 that cleans the surface of the photosensitive element 5, and the like. In, FIG. 1, the photosensitive element 5, the charging device 6, the developing device 7, and the cleaning device 8 included in the black image forming unit 4K are given reference numerals, and the components included in the other image forming units 4Y, 4M, and 4C are illustrated without reference numerals.

Provided under the image forming units 4Y, 4M, 4C, and 4K is an exposing device 9 that exposes the surfaces of the photosensitive elements 5. The exposing device 9 has a light source, a polygon mirror, an f-θ lens, a reflecting mirror, and the like, and is configured to radiate laser light onto the surfaces of the photosensitive elements 5 according to image data.

Provided above the image forming units 4Y, 4M, 4C, and 4K is a transfer device 3. The transfer device 3 includes an intermediate transfer belt 30 as a transfer body, four primary transfer rollers 31 as primary transfer units, a secondary transfer roller 36 as a secondary transfer unit, a secondary transfer backup roller 32, a cleaning backup roller 33, a tension roller 34, and a belt cleaning device 35.

The intermediate transfer belt 30 is an endless belt that is extended by the secondary transfer backup roller 32, the cleaning backup roller 33, and the tension roller 34. In this arrangement, when the secondary transfer backup roller 32 is driven and rotated, the intermediate transfer belt 30 revolves (rotates) in a direction illustrated by arrow in the drawing.

Each of the four primary transfer rollers 31 and each of the photosensitive elements 5 sandwich the intermediate transfer belt 30 therebetween to form a primary transfer nip. In addition, the primary transfer rollers 31 are connected to a power source not illustrated, such that a predetermined direct voltage (DC) and/or alternating voltage (AC) are applied to the primary transfer rollers 31.

The secondary transfer roller 36 and the secondary transfer backup roller 32 sandwich the intermediate transfer belt 30 therebetween to form a second transfer nip. In addition, as with the primary transfer rollers 31, the secondary transfer roller 36 is connected to a power source not illustrated, such that a predetermined direct voltage (DC) and/or alternating voltage (AC) are applied to the secondary transfer roller 36.

The belt cleaning device 35 has a cleaning brush and a cleaning blade that are arranged so as to abut the intermediate transfer belt 30. A waste toner carrying horse, not illustrated, extending from the belt cleaning device 35 is connected to an entry portion of a waste toner container not illustrated.

A bottle containing unit 2 is provided at an upper part of the printer main body, and four toner bottles 2Y, 2M, 2C, and 2K containing toner supplies are detachably attached to the bottle containing unit 2. Supply paths, not illustrated, are provided between the toner bottles 2Y, 2M, 2C, and 2K and the developing devices 7, such that the toner is supplied through the supply paths from the toner bottles 2Y, 2M, 2C, and 2K into the developing devices 7.

Meanwhile, provided at a lower part of the printer main body are a paper feed tray 10 storing paper P as a recording medium, a paper feeding roller 11 feeding out the paper P from the paper feed tray 10, and the like. In this arrangement, the recording medium includes plain paper, cardboard, postcards, envelopes, thin paper, processed paper (coated paper, art paper, and the like), tracing paper, OHP sheets, and the like. In addition, although not illustrated, a manual paper feed mechanism may be provided in the printer.

The printer main body has a conveying path R arranged to pass the paper P from the paper feed tray 10 through the secondary transfer nip and discharge the paper P out of the device. In the conveying path R, a pair of registration rollers 12 is provided as a conveying unit to convey the paper P to the secondary transfer nip, on an upstream side of the position of the secondary transfer roller 36 with respect to a direction of paper conveyance.

In addition, provided on a downstream side of the position of the secondary transfer roller 36 with respect to the direction of paper conveyance is a fixing device 20 to fix an unfixed image transferred to the paper P. Further, provided in the conveying path R on the downstream side of the fixing device 20 with respect to the direction of paper conveyance is a pair of discharging rollers 13 to discharge the paper out of the device. In addition, provided on an upper surface of the printer main body is a discharge tray 14 to stock paper discharged out of the device.

Subsequently, referring to FIG. 1, a basic operation of the printer according to the embodiment will be described.

When an image forming operation is started, the photosensitive elements 5 of the image forming units 4Y, 4M, 4C, and 4K are driven and rotated by a driving device not illustrated, clockwise illustrated in the drawing, and the charging device 6 charges uniformly the surfaces of the photosensitive elements 5 with a predetermined polarity. The surfaces of the photosensitive elements 5 are irradiated with laser light from the exposing device 9 to form static latent images on the surfaces of the photosensitive elements 5. In this arrangement, image information exposed to the photosensitive elements 5 is single-color image information obtained by dividing a desired full-color image into color information of yellow, magenta, cyan, and black. When the developing devices 7 supply toner to the static latent images formed on the photosensitive elements 5, the static latent images are developed (made visible) as toner images.

In addition, when the image forming operation is started, the secondary transfer backup roller 32 is driven and rotated counterclockwise illustrated in the drawing to allow the intermediate transfer belt 30 to revolve in a direction illustrated by arrow in the drawing. Then, a constant voltage in reverse of the charged polarity of the toner or a voltage under constant current control is applied to the primary transfer rollers 31. Accordingly, transfer electric fields are formed at the primary transfer nips between the primary transfer rollers 31 and the photosensitive elements 5.

After that, when the toner images of the colors on the photosensitive elements 5 reach the primary transfer nips according to the rotation of the photosensitive elements 5, the toner images on the photosensitive elements 5 are sequentially superimposed and transferred on the intermediate transfer belt 30 by the transfer electric fields formed at the primary transfer nips. Accordingly, the full-color toner image is carried on the surface of the intermediate transfer belt 30. The cleaning device 8 removes the toner on the photosensitive elements 5 not transferred to the intermediate transfer belt 30. After that, a neutralization device not illustrated neutralizes the surfaces of the photosensitive elements 5 to initialize surface potentials.

At the lower part of the image forming device, the paper feeding roller 11 starts to be driven and rotated, and the paper P is fed from the paper feed tray 10 into the conveying path R. The registration rollers 12 sends timely the paper P having been fed into the conveying path R, to the second transfer nip between the secondary transfer roller 36 and the secondary transfer backup roller 32. At that time, a transfer voltage is applied to the secondary transfer roller 36 in reverse of the toner charged polarity of the toner images on the intermediate transfer belt 30, thereby to form a transfer electric field at the secondary transfer nip.

After that, when the toner image on the intermediate transfer belt 30 reaches the secondary transfer nip according to the revolution of the intermediate transfer belt 30, the toner images on the intermediate transfer belt 30 are collectively transferred to the paper P by the transfer electric field formed at the secondary transfer nip. In addition, the belt cleaning device 35 removes residual toner on the intermediate transfer belt 30 not transferred to the paper P at that time, and the removed toner is conveyed and collected into a waste toner container not illustrated.

After that, when the paper P is conveyed to the fixing device 20, the fixing device 20 fixes the toner image on the paper P, to the paper P. Then, the paper P is discharged by the discharging rollers 13 out of the device, and stocked on the discharge tray 14.

The foregoing description is made on an image forming operation for forming a full-color image on paper. Alternatively, one of the four image forming units 4Y, 4M, 4C, and 4K may be used to form a single-color image, or two or three image forming units may be used to form a two-color or three-color image.

Next, a configuration of the fixing device 20 will be described with reference to FIG. 2.

Figure 2:
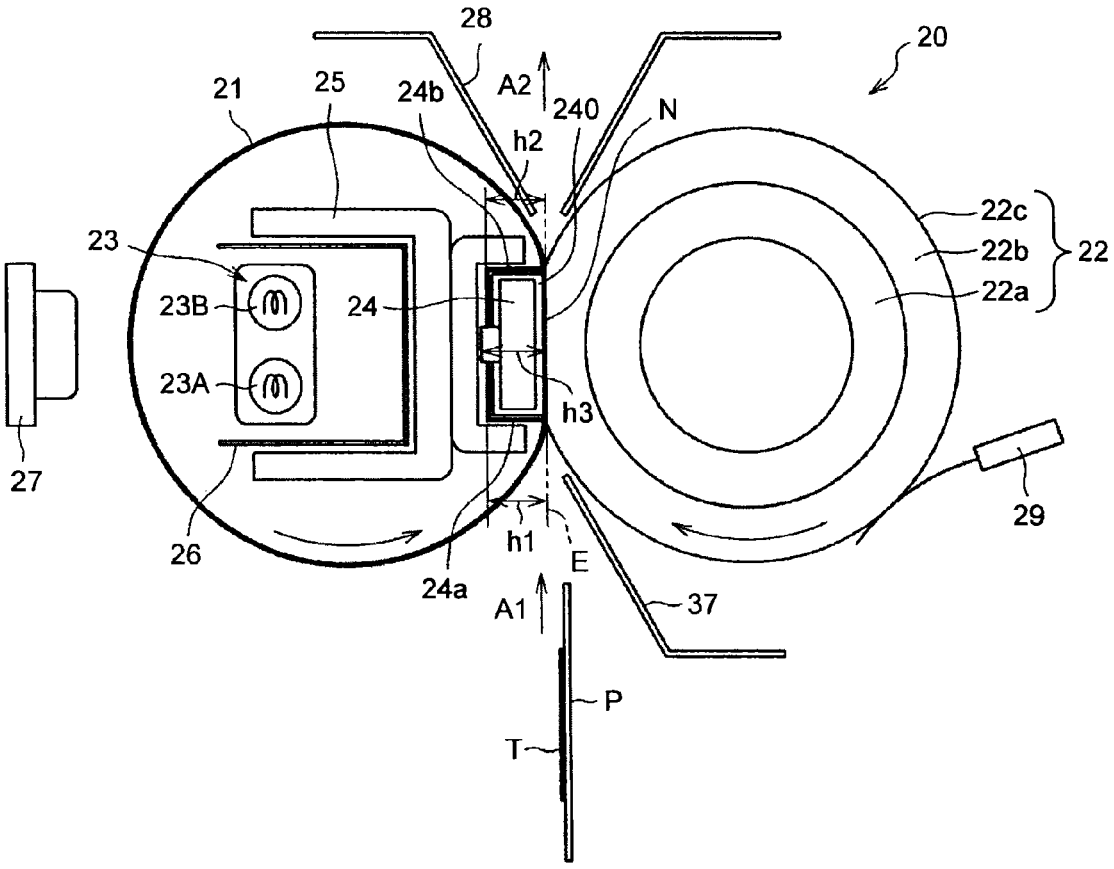
FIG. 2 is a schematic configuration diagram of a fixing device mounted in the image forming device.

As illustrated in FIG. 2, the fixing device 20 includes: a fixing belt 21 as a rotatable fixing member; a pressing roller 22 as a rotatable pressing member opposed to the fixing belt 21; a halogen heater 23 as a heat source that heats the fixing belt 21; a nip forming member 24 and a stay 25 as supporting members arranged inside the fixing belt 21; a reflecting member 26 that reflects light from the halogen heater 23 toward the fixing belt 21; thermopiles 27 as temperature detection sensors that detect the temperature of the fixing belt 21; a thermistor 29 as a temperature detection sensor that detects the temperature of the pressing roller 22; a separating member 28 that separates the paper from the fixing belt 21; a pressing unit not illustrated that presses the pressing roller 22 against the fixing belt 21, and the like.

The fixing belt 21 is formed by a thin-walled and flexible endless belt member (including a film). More specifically, the fixing belt 21 is configured to have an inner peripheral base material made of a metal material such as nickel or SUS or a resin material such as polyimide (PI), and an outer peripheral release layer made of tetrafluoroethylene-perfluoroalkylvinylether copolymer (PFA) or polytetrafluoroethylene (PTFE). In addition, an elastic layer made of a rubber material such as silicone rubber, foaming silicone rubber, or fluorine-contained rubber may intervene between the base material and the release layer.

The pressing roller 22 is configured to have a metal core 22*a*; an elastic layer 22*b* that is made of foamed silicone rubber, silicone rubber, or fluorine-contained rubber or the like and is provided on a surface of the metal core 22*a*; and a release layer 22*c* that is made of PFA or PTFE or the like and is provided on a surface of the elastic layer 22*b*. The pressing roller 22 is pressed by a pressing unit not illustrated against the fixing belt 21 to abut the nip forming member 24 via the fixing belt 21. At a position where the pressing roller 22 is pressed and contacted with the fixing belt 21, the elastic layer 22*b* of the pressing roller 22 is crushed to form a nip portion N with a predetermined width. In addition, the pressing roller 22 is configured to be driven and rotated by a driving source such as a motor not illustrated which is provided in the printer main body. When the pressing roller 22 is driven and rotated, a driving force of the same is transferred to the fixing belt 21 at the nip portion N to allow the fixing belt 21 to be driven and rotated.

In the embodiment, the pressing roller 22 is of a hollow roller, but may be of a solid roller. In addition, the pressing roller 22 may have a heat source such as a halogen heater therewithin. With no elastic layer, the pressing roller 22 has a smaller heat capacity and provides an improved fixing property. In this case, however, when unfixed toner is crushed and fixed, minute asperities on the belt surface may be transferred to an image, thereby to cause uneven brightness at solid portions of the image. To prevent this, it is desired to provide an elastic layer with a thickness of 100 μm or more. Providing such an elastic layer with a thickness of 100 μm or more makes it possible to absorb minute asperities by elastic deformation of the elastic layer and avoid occurrence of uneven brightness. The elastic layer 22*b* may be made of solid rubber, but if there is no heat source within the pressing roller 22, the elastic layer 22*b* may be made of sponge rubber. Sponge rubber is more desired because the material provides higher heat insulation and makes it less prone to allow heat from the fixing belt 21 to escape. In addition, the fixing member and the pressing member may not necessarily be pressed and contacted with each other, but may be simply contacted with each other without being pressed.

In the embodiment, the halogen heater 23 includes two halogen heaters 23A and 23B, and the halogen heaters 23A and 23B are fixed at both end portions thereof to side plates (not illustrated) of the fixing device 20. The halogen heaters 23A and 23B are each configured to generate heat under power control by the power supplying unit provided in the printer main body. The power control is performed according to the surface temperature of the fixing belt 21 detected by the thermopile 27. The power control over the halogen heaters 23A and 23B makes it possible to set the temperature (fixing temperature) of the fixing belt 21 at a desired temperature. In addition, the heat source heating the fixing belt 21 may be a heat generator other than a halogen heater, for example, a ceramic heater or an IH heater.

The nip forming member 24 is longitudinally provided along an axial direction of the fixing belt 21 or an axial direction of the pressing roller 22, and is fixed and supported by the stay 25. This makes it possible to support a pressure from the pressing roller 22, prevent warpage of the nip forming member 24, and obtain a uniform nip width along the axial direction of the pressing roller 22. In addition, the stay 25 is desirably made of a metal material with a high mechanical strength, such as stainless steel or iron, to satisfy the function of preventing warpage of the nip forming member 24. Further, the stay 25 can be formed with a horizontally long cross section extending in a direction of pressing of the pressing roller 22, which increases a section modulus and improves the stay 25 in mechanical strength.

In addition, the nip forming member 24 is formed by a heat-resistance member with a heatproof temperature of 200° C. or more. This makes it possible to prevent thermal deformation of the nip forming member 24 in a toner fixing temperature range, keep the nip portion N in a stable state, and provide stable output image quality. The nip forming member 24 can be made of a general heat-resistance resin such as polyether sulfone (PES), polyphenylene sulfide (PPS), liquid crystal polymer (LCP), polyether nitrile (PEN), polyamide imide (PAI), or polyether ether ketone (PEEK). Used in the embodiment is LPC TI-8000 manufactured by Toray Industries, Inc.

In addition, the nip forming member 24 has a low-friction sheet 240 on a surface thereof. When the fixing belt 21 rotates, the fixing belt 21 slides over the low-friction sheet 240 to reduce a drive torque generated on the fixing belt 21 and lighten a load on the fixing belt 21 resulting from a friction force. A preferred material for the low-friction sheet 240 is, for example, Toyoflon (registered trademark) 401 manufactured by Toray Industries, Inc. or the like.

The reflecting member 26 is disposed between the stay 25 and the halogen heater 23. Due to the disposition of the reflecting member 26, light emitted from the halogen heater 23 toward the stay 25 is reflected on the fixing belt 21. This makes it possible to irradiate a larger amount of light to the fixing belt 21 to heat the fixing belt 21 with high efficiency. In addition, the reflecting member 26 can suppress transfer of radiation heat from the halogen heater 23 to the stay 25 or the like, thereby achieving energy saving.

In addition, the fixing device 20 according to the embodiment is configured with various contrivances for the purposes of further improvements in energy saving and first print time and the like.

Specifically, the fixing belt 21 can be heated directly by the halogen heater 23 at portions other than the nip portion N (direct heating method). In the embodiment, there is nothing between the halogen heater 23 and a left side portion of the fixing belt 21 illustrated in FIG. 2, such that, there, radiation heat from the halogen heater 23 is directly given to the fixing belt 21.

In addition, to realize a lower heat capacity of the fixing belt 21, the fixing belt 21 is made thin and small in diameter. Specifically, thicknesses of the base material, the elastic layer, and the release layer constituting the fixing belt 21 are set within the ranges of 20 to 50 μm 100 to 300 μm, and 10 to 50 m, respectively, so that the entire belt has a thickness of 1 mm or less. In addition, a diameter of the fixing belt 21 is set to 20 to 40 mm. For a further lower heat capacity, the thickness of the entire fixing belt 21 is desirably set to 0.2 mm or less, more desirably 0.16 mm or less. In addition, the diameter of the fixing belt 21 is desirably set to 30 mm or less.

In the embodiment, the diameter of the pressing roller 22 is set to 20 to 40 mm, such that the diameter of the fixing belt 21 is equivalent to the diameter of the pressing roller 22. However, the embodiment is not limited to this configuration. For example, the diameter of the fixing belt 21 may be smaller than the diameter of the pressing roller 22. In that case, the curvature of the fixing belt 21 at the nip portion N is smaller than the curvature of the pressing roller 22, and thus the recording medium discharged from the nip portion N is easy to separate from the fixing belt 21.

As in the foregoing, when the fixing belt 21 is made smaller in diameter, the fixing belt 21 has a smaller inner space. In the embodiment, the stay 25 is folded on the both end sides and shaped in a concave, and the halogen heater 23 is stored on the inside of the concave-shaped portion. This makes it possible to arrange the stay 25 and the halogen heater 23 within the small space.

To provide the stay 25 in a maximum size within the smaller space, the nip forming member 24 is in contrast made compact. Specifically, the width of the nip forming member 24 along the direction of paper conveyance is made smaller than the width of the stay 25 along the direction of paper conveyance. Further, if it is assumed that, in FIG. 2, heights of an upstream-side end portion 24*a* and a downstream-side end portion 24*b* of the nip forming member 24 with respect to the nip portion N (or a virtual extended line E) along the direction of paper conveyance are designated as h1 and h2; and a maximum height of a portion of the nip forming member 24 other than the upstream-side end portion 24*a* and the downstream-side end portion 24*b* with respect to the nip portion N (or the virtual extended line E) is designated as h3, the nip forming member 24 is configured to meet relations h1≤h3 and h2≤h3. In the foregoing configuration, the upstream-side end portion 24*a* and the downstream-side end portion 24*b* of the nip forming member 24 do not intervene between the fixing belt 21 and the folded portions of the stay 25 on the upstream and downstream sides along the paper conveyance direction. This makes it possible to dispose the folded portions closer to the inner peripheral surface of the fixing belt 21. Accordingly, the stay 25 can be provided in a maximum size within the limited internal space of the fixing belt 21 to ensure strength of the stay 25. As a result, it is possible to prevent warpage of the nip forming member 24 by the pressing roller 22 and realize improvement in fixing property.

Referring to FIG. 2, a basic operation of the fixing device according to the embodiment will be described below.

When the printer main body is switched on, power is supplied to the halogen heater 23, and the pressing roller 22 starts to be driven and rotated clockwise illustrated in FIG. 2. Accordingly, the fixing belt 21 is driven by a force of friction with the pressing roller 22 and rotated counterclockwise illustrated in FIG. 2.

After that, the paper P on which an unfixed toner image T is carried at the foregoing image forming step, is guided and conveyed by a guide plate 37 in a direction of arrow A1 illustrated in FIG. 2, and is sent into the nip portion N between the fixing belt 21 and the pressing roller 22 in a pressed and contacted state. Then, the toner image T is fixed onto the surface of the paper P by heat from the fixing belt 21 heated by the halogen heater 23 and a pressing force between the fixing belt 21 and the pressing roller 22.

The paper P with the toner image T fixed thereon is removed from the nip portion N in a direction of arrow A2 illustrated in FIG. 2. At that time, when a leading end of the paper P contacts a leading end of the separating member 28, the paper P is separated from the fixing belt 21. After that, the separated paper P is discharged out of the device by the discharging roller as described above, and is stocked on the discharge tray.

Features of the embodiment will be described below.

Figure 3:
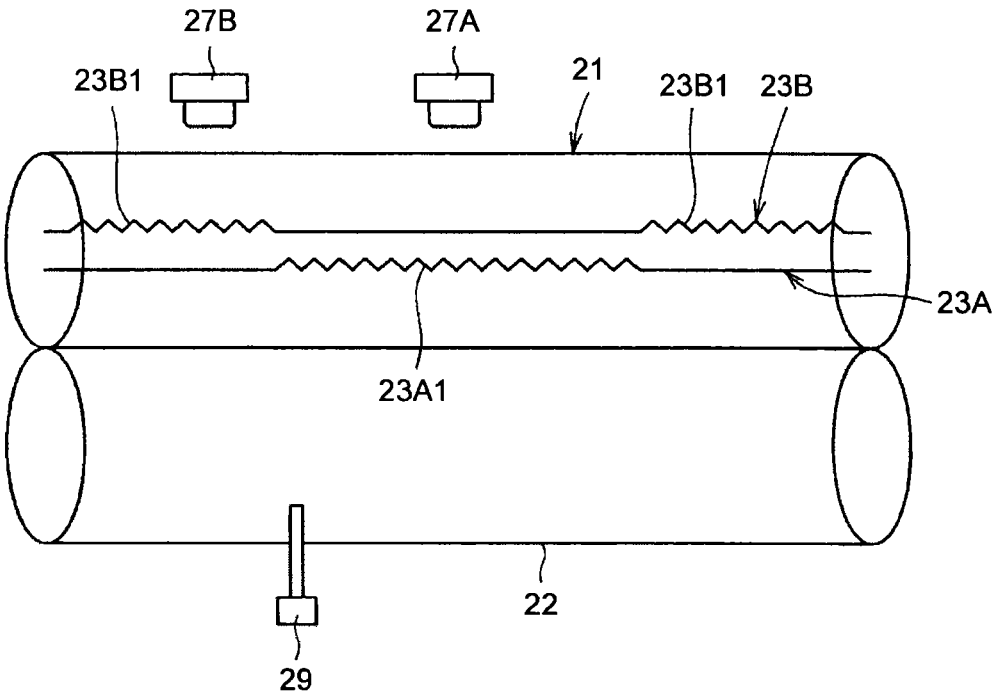
FIG. 3 is a conceptual view of heat sources (halogen heaters) and temperature detection sensors (thermopiles and thermistor) of the fixing device.

Referring to FIG. 3, if it is assumed that the lower halogen heater 23A is designated as first halogen heater and the upper halogen heater 23B is designated as second halogen heater, the first halogen heater 23A and the second halogen heater 23B have heat generating units arranged at different positions.

Specifically, the first halogen heater 23A has a heat generating unit (light emission unit) 23A1 arranged within predetermined areas ranging from a longitudinally central portion. In the embodiment, the heat generating unit 23A1 is provided in the areas of 200 to 220 mm symmetric with respect to the longitudinally central portion of the first halogen heater 23A.

Meanwhile, the second halogen heater 23B has heat generating units (light emission units) 23B1 at both longitudinal end portions thereof. In the embodiment, the heat generating units 23B1 are arranged in areas symmetric with respect to a longitudinally central portion of the second halogen heater 23B, ranging from 200 to 220 mm to 300 to 330 mm from the central portion. In general, the paper feed width for A3 paper and A4 paper in landscape orientation is 297 mm. However, the total length of the heat generating unit 23A1 positioned at the center of the first halogen heater 23A and the heat generating units 23B1 positioned at both the ends of the second halogen heater 23B is set to 300 to 330 mm that is longer than the foregoing paper feed width. This is because outer end portions of the heat generating units 23B1 generate a smaller amount of heat (lower in emission intensity) and cause a temperature drop, and thus the paper feed region needs to have a predetermined or larger amount of heat (heat generation intensity).

In the embodiment, two thermopiles 27 are provided to detect the temperature of the fixing belt 21. Referring to FIG. 3, a right thermopile 27A is designated as first thermopile and a left thermopile 27B is designated as second thermopile, the first thermopile 27A corresponds to the heat generating unit 23A1 of the first halogen heater 23A and detects the temperature of a central region of the fixing belt 21, and the second thermopile 27B corresponds to the heat generating units 23B1 of the second halogen heater 23B and detects the temperature of end regions of the fixing belt 21.

Figure 4:
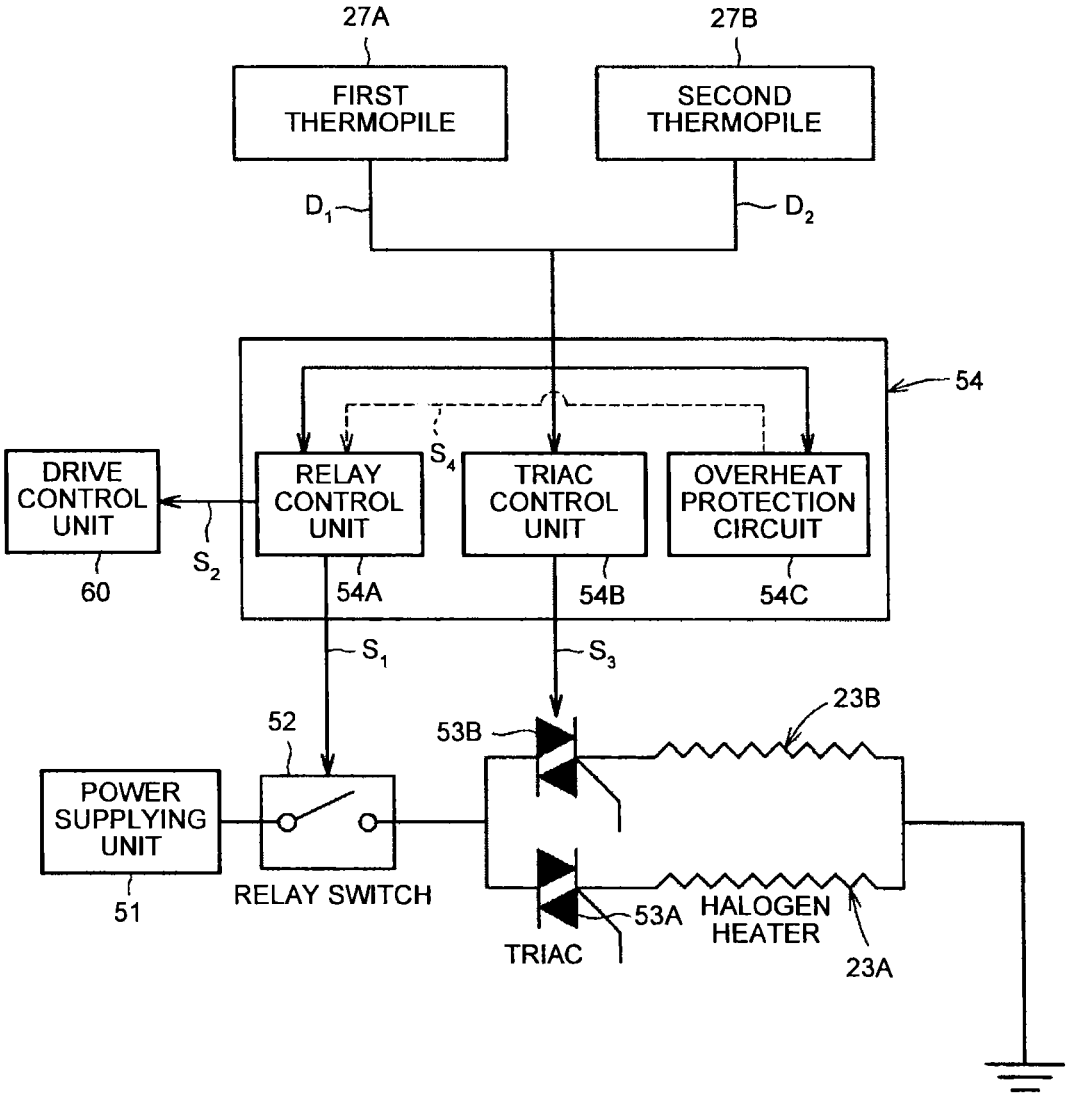
FIG. 4 is a diagram illustrating a control circuit of the fixing device.

FIG. 4 illustrates one configuration example of a control circuit of the fixing device 20. Power from a power supplying unit 51 is supplied to the halogen heaters 23A and 23B via a relay switch 52, triacs 53A and 53B. The relay switch 52 is generally turned on (closed) at warm-up, during execution of a print job (paper feed), in the stand-by mode and the lower-power mode, and the like, and is turned off (open) at power-off, in the off/sleep mode, at an abnormal emergency stop, and the like. The triacs 53A and 53B control energization of the first halogen heater 23A and the second halogen heater 23B, and feed back temperature information of the fixing belt 21 detected by the first thermopile 27A and the second thermopile 27B, thereby to control the fixing belt 21 at a predetermined temperature.

An control unit 54 includes a relay control unit 54A that controls the relay switch 52, a triac control unit 54B that controls the triacs 53A and 53B, and an overheat protection circuit 54C that outputs an abnormal stop signal at occurrence of an excessive rise in temperature of the fixing belt 21. Input into the control unit 54 is information on temperatures of the central region and the end regions of the fixing belt 21 detected by the first thermopile 27A and the second thermopile 27B, as temperature information values (voltage values) $D_1$ and $D_2$. In the embodiment, the relay control unit 54A is configured to output an ON/OFF control signal $S_1$ to the relay switch 52 and output a drive control signal $S_2$ to a drive control unit 60 of the pressing roller 22, according to the temperature information values $D_1$ and $D_2$. The triac control unit 54B is configured to output an energization control signal $S_3$ to the triacs 53A and 53B, according to the temperature information values $D_1$ and $D_2$. The overheat protection circuit 54C is configured to output an abnormal stop signal $S_4$ to the relay control unit 54A, according to the temperature information values $D_1$ and $D_2$. However, the embodiment is not limited to the foregoing configurations. For example, the triac control unit 54B may be configured to output the energization control signal $S_3$ to the relay switch 52, and the overheat protection circuit 54C may be configured to output the abnormal stop signal $S_4$ directly to the relay switch 52 and the drive control unit 60. In addition, the overheat protection circuit 54C may be configured to output the abnormal stop signal $S_4$ at occurrence of an excessive rise in temperature of not only the fixing belt 21 but also the pressing roller 22 (in this case, the thermistor 29 detecting the temperature of the pressing roller 22 also inputs the temperature detection signal into the overheat protection circuit 54C). Further, an arrangement for outputting the drive control signal $S_2$ to the drive control unit 60 may be eliminated.

When the fixing belt 21 and the pressing roller 22 stop rotation, if the temperature of the fixing belt 21 is equal to or more than a predetermined temperature, in the embodiment, when one or both of the temperature information values $D_1$ and $D_2$ from the first thermopile 27A and the second thermopile 27B are equal to or larger than a reference value R1 corresponding to a predetermined temperature $T_1$ ($D_1 \geq R_1$ or/and $D_2 \geq R_1$), the relay control unit 54A keeps the relay switch 52 in the off-state.

In the embodiment, the relay control unit 54A uses the temperature information values $D_1$ and $D_2$ as voltage values input from the first thermopile 27A and the second thermopile 27B as they are without converting the same into temperature values, and compares the temperature information values $D_1$ and $D_2$ with the reference value R1 as a voltage value corresponding to the predetermined temperature $T_1$ as a reference value, and then performs the foregoing process. This allows the process at the relay control unit 54A to be simplified and accelerated. However, the embodiment is not limited to this configuration, but may be configured to convert the temperature information values $D_1$ and $D_2$ input from the first thermopile 27A and the second thermopile 27B into temperature values and compare these temperature values with the predetermined temperature $T_1$ as a reference value, and cause the relay control unit 54A to perform the control process.

Figure 5:
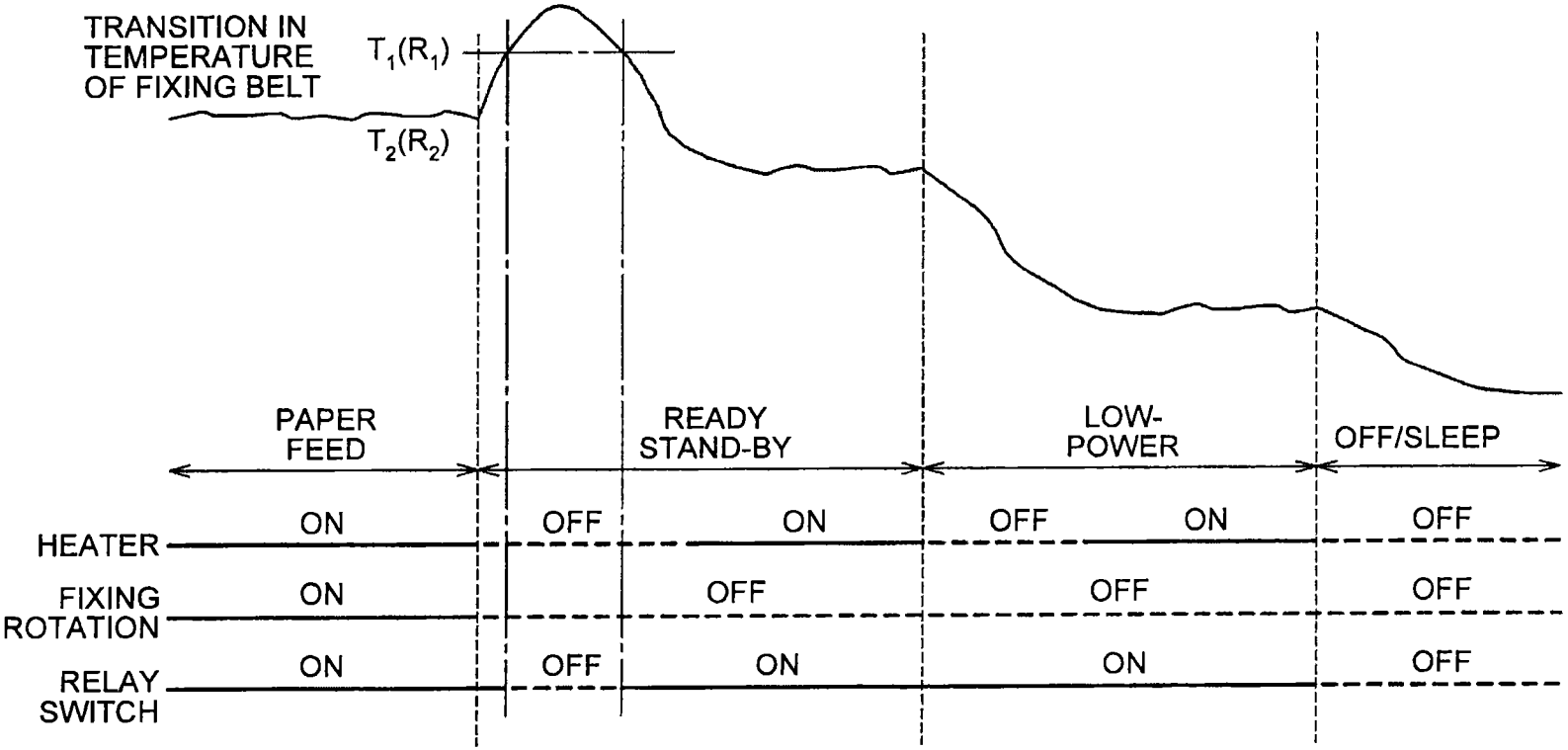
FIG. 5 is a diagram illustrating temporal changes in temperature of a fixing belt.

Referring to FIG. 4 and FIG. 5 illustrating temporal changes in temperature of the fixing belt 21, shifts of the image forming device from the paper feed mode (execution of a print job) to the stand-by mode, the low-power mode, and the off/sleep mode as examples, will be specifically described below. For example, after completion of a print job, if a predetermined period of time has elapsed without input of an operation signal, the image forming device shifts to the stand-by mode to stop rotation of the fixing belt 21 and the pressing roller 22 and stop energization of the first halogen heater 23A and the second halogen heater 23B by the triac control unit 54B. Then, after the shift to the stand-by mode, if a predetermined period of time has elapsed, the image forming device shifts to the low-power mode. After the shift to the low-power mode, if a predetermined period of time has elapsed, the image forming device shifts to the off/sleep mode. The rotation of the fixing belt 21 and the pressing roller 22 is stopped at a shift to the stand-by mode, and subsequently, the fixing belt 21 and the pressing roller 22 are kept in the stopped state. The energization of the first halogen heater 23A and the second halogen heater 23B is stopped at a shift to the stand-by mode and a shift to the low-power mode respectively, and is resumed when the temperature of the fixing belt 21 is lowered to a predetermined temperature in each of the stand-by mode and the low-power mode. The relay switch 52 is generally kept in the on (closed) state in the stand-by mode and the low-power mode, but in the embodiment, if the temperature of the fixing belt 21 is equal to or more than the predetermined temperature $T_1$ in the stand-by mode, the relay switch 52 is turned off (opened) and kept in the off state as described later. In the off/sleep mode, the rotation of the fixing belt 21 and the pressing roller 22, and the energization of the first halogen heater 23A and the second halogen heater 23B, are stopped, and the relay switch 52 is turned off.

When the image forming device shifts from the paper feed mode to the stand-by mode, the fixing belt 21 and the pressing roller 22 stop rotation and the triac control unit 54B stops the energization of the halogen heaters 23A and 23B. Since the halogen heaters 23A and 23B have residual heat for a while after the stoppage of the energization, the fixing belt 21 in the stopped state is heated by the residual heat, and thus the fixing belt 21 may be excessively raised in temperature on a temporary basis. Then, if the thermopiles 27A and 27B detect the temporary excessive rise in temperature of the fixing belt 21 and input the temperature information values $D_1$ and $D_2$ to the control unit 54, the overheat protection circuit 54C of the control unit 54 misjudges this state as abnormal and stops operation of the fixing device 20.

Accordingly, in the embodiment, if one or both of the temperature information values $D_1$ and $D_2$ from the thermopiles 27A and 27B are equal to or higher than the reference value R1 corresponding to the predetermined temperature $T_1$ in the stand-by mode, the relay switch 52 is turned off (opened) and kept in the off state, and when one or both of the temperature information values $D_1$ and $D_2$ become equal to or less than the reference value $R_1$, the relay switch 52 is turned on (closed). Accordingly, it is possible to continue the stand-by mode safely and appropriately without causing an abnormal stop due to misjudgment of the overheat protection circuit 54C.

In the example illustrated in FIG. 5, the predetermined temperature $T_1$ (reference value $R_1$) for keeping the relay switch 52 in the off state is set higher than the temperature $T_2$ of the fixing belt 21 in the paper feed mode (the corresponding temperature information values $D_1$ and $D_2$ are $R_2$). Alternatively, the foregoing predetermined temperature $T_1$ (reference value $R_1$) may be set identical to or lower than the temperature $T_2$ ($R_2$). In addition, if the fixing belt 21 is excessively raised in temperature on a temporary basis in the low-power mode or other modes, the relay switch 52 may be kept in the off state in the same matter as described above in those modes.

Figure 6:
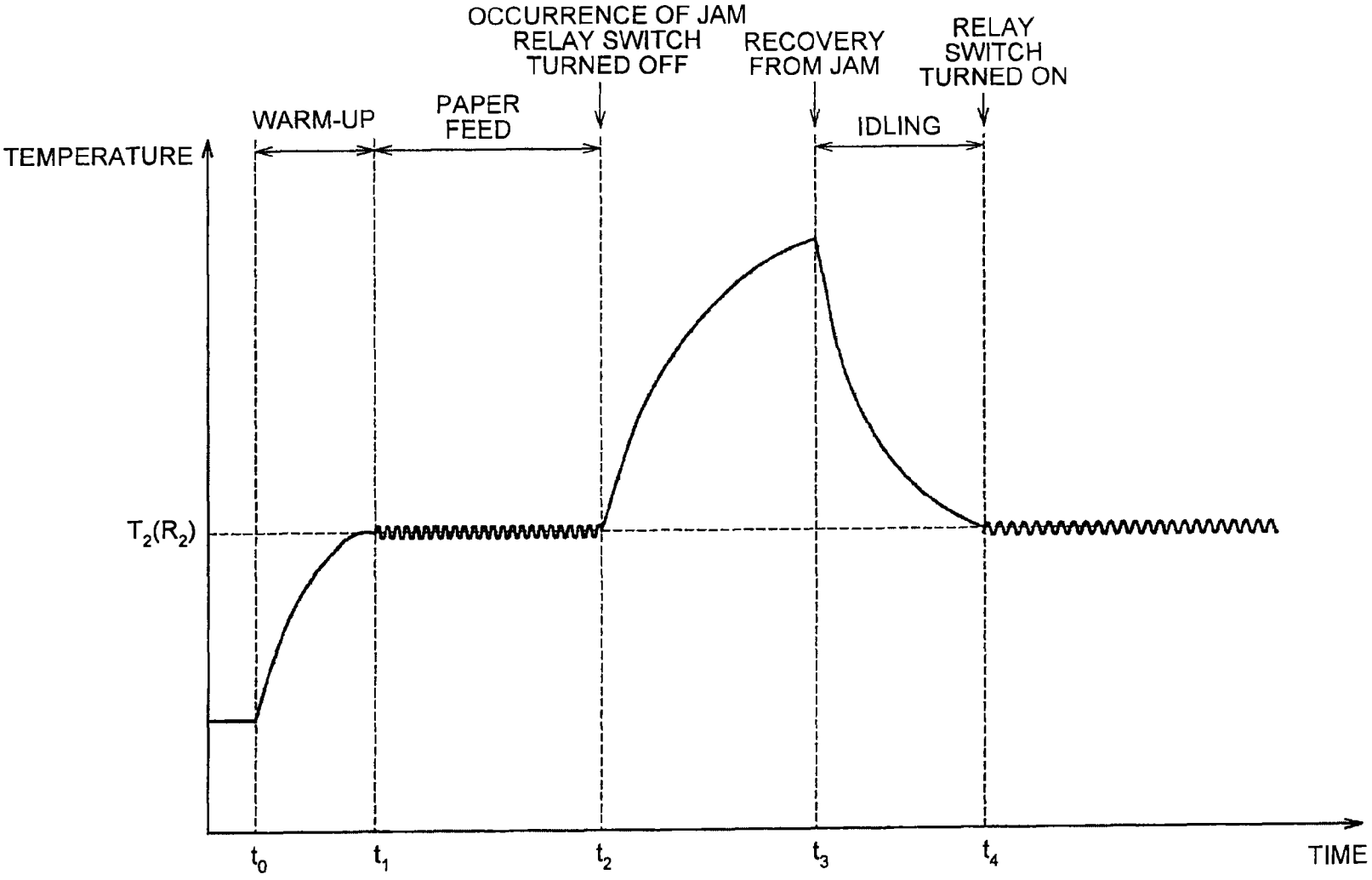
FIG. 6 is a diagram illustrating temporal changes in temperature of a fixing belt in another embodiment.

Next, referring to FIG. 4 and FIG. 6 illustrating temporal changes in temperature of the fixing belt 21, another case will be specifically described below in which the paper P is jammed during execution of a print job (paper feed) and the fixing device 20 is suddenly stopped, for example.

In the embodiment, under predetermined conditions in which the relay switch 52 is turned off and power supply from the power supplying unit 51 to the halogen heaters 23A and 23B is stopped and rotation of the fixing belt 21 and the pressing roller 22 is stopped, the relay control unit 54A keeps the relay switch 52 in the off state if a predetermined external operation is performed when the temperature of the fixing belt 21 is equal to or higher than a predetermined temperature, for example, when one or both of the temperature information values $D_1$ and $D_2$ from the first thermopile 27A and the second thermopile 27B are equal to or higher than the reference value $R_2$ corresponding to the predetermined temperature $T_2$ ($D_1 \geq R_2$ or/and $D_2 \geq R_2$). The foregoing predetermined conditions include a state where the image forming device 1 is powered off to stop activation, a state where the fixing device 20 is in the off/sleep mode, and a state where the image forming device 1 is suddenly stopped due to jamming of the paper P or for other reasons. In addition, the foregoing predetermined external operation includes an operation for powering on and restarting the image forming device 1, an operation for instructing the image forming device 1 to execute image forming (a print job), and an operation for recovering the image forming device 1 from the suddenly stopped state. In the example illustrated in FIG. 6, the predetermined temperature $T_2$ (reference value $R_2$) for keeping the relay switch 52 in the off state is set identical to or similar to the temperature of the fixing belt 21 in the paper feed mode. Alternatively, the predetermined temperature $T_2$ (reference value $R_2$) may be set higher than the temperature of the fixing belt 21 in the paper feed mode.

In the embodiment, under the foregoing condition ($D_1 \geq R_2$ or/and $D_2 \geq R_2$), the relay control unit 54A keeps the relay switch 52 in the off state and outputs the drive control signal $S_2$ to the drive control unit 60 to let the fixing belt 21 and the pressing roller 22 rotate (idle). Accordingly, it is possible to alleviate local excessive rise in temperature of the fixing belt 21 and shorten a time required to enable power supply from the power supplying unit 51 to the halogen heaters 23A and 23B ($D_1 \leq R_2$ and $D_2 \leq R_2$). In this arrangement, when the fixing belt 21 and the pressing roller 22 are idled, the fixing belt 21 and the pressing roller 22 preferably contact each other under a pressure adapted to be identical or similar to a pressing force on the paper P passing through the nip portion N. This makes it possible to alleviate more quickly local excessive rise in temperature of the fixing belt 21.

Referring to FIG. 6, when the fixing device 20 starts a warm-up operation (activating the halogen heaters 23A and 23B and rotating the fixing belt 21 and the pressing roller 22)

(time $t_0$), the temperature of the fixing belt 21 rises. When the temperature of the fixing belt 21 reaches a fixing temperature (temperature $T_2$), a print job (paper feed) is started (time $t_1$). Then, if the paper P is jammed during execution of the print job (paper feed), an appropriate detecting unit detects occurrence of the jam, and the image forming device 1 is suddenly stopped (time $t_2$). At that time, the fixing belt 21 and the pressing roller 22 stop rotation and the relay switch 52 is turned off, thereby to stop power supply to the halogen heaters 23A and 23B. The image forming device 1 can be recovered (restored) from the jam by pulling a jammed portion out of the image forming device 1, removing the jammed paper P, and then resetting the jammed portion to the image forming device 1, or pressing a command button for starting the print job after resetting the jammed portion (time $t_3$). For a period of time between the instant when the image forming device 1 is suddenly stopped and the instant when any external operation for recovery from the jam is performed ($t_2$ to $t_3$), the fixing belt 21 in the stopped state is heated by residual heat of the halogen heaters 23A and 23B. At that time, temperatures of glass tubes of the halogen heaters 23A and 23B are 400 to 600° C., and thus a portion of the fixing belt 21 in the vicinity of the halogen heaters 23A and 23B may be locally heated and excessively raised in temperature on a temporary basis at recovery from the jam (time $t_3$). In this state, if an attempt is made to turn on the relay switch 52 to restart the print job, the overheat protection circuit 54C of the control unit 54 misjudges this state as abnormal according to the temperature information values $D_1$ and $D_2$ input from the first thermopile 27A and the second thermopile 27B, and stops again operation of the fixing device 20.

Accordingly, in the embodiment, when an external operation for recovery from the jam is performed as described above (time $t_3$), if one or both of the temperature information values $D_1$ and $D_2$ from the first thermopile 27A and the second thermopile 27B are equal to or more than the reference value $R_2$ (corresponding to the predetermined temperature $T_2$), the overheat protection circuit 54C is not activated (the triac control unit 54B is also not activated), the relay control unit 54A keeps the relay switch 52 in the off state and outputs the drive control signal $S_2$ to the drive control unit 60 to let the fixing belt 21 and the pressing roller 22 rotate (idle). This state is continued until both of the temperature information values $D_1$ and $D_2$ from the first thermopile 27A and the second thermopile 27B become equal to or less than the reference value $R_2$ (corresponding to the predetermined temperature $T_2$) (time $t_4$). Then, when both of the temperature information values $D_1$ and $D_2$ from the first thermopile 27A and the second thermopile 27B become equal to or less than the reference value $R_2$ (time $t_4$), the relay control unit 54A turns the relay switch 52 on to enable energization of the halogen heaters 23A and 23B. Subsequently, the image forming device 1 shifts to a normal temperature control program in which temperature control is performed by the triac control unit 54B and the overheat protection circuit 54C, and then restarts the print job. The foregoing control performed by the relay control unit 54A makes it possible to avoid trouble that, at recovery from occurrence of the jam, the operation of the fixing device 20 is stopped again due to a false operation of the overheat protection circuit 54C. In addition, the rotation of the fixing belt 21 and the pressing roller 22 alleviates a local excessive rise in temperature of the fixing belt 21, and lowers the fixing belt 21 to the fixing temperature $T_2$ in a relatively short time. This shortens a time required before restart of the print job.

Figure 7:
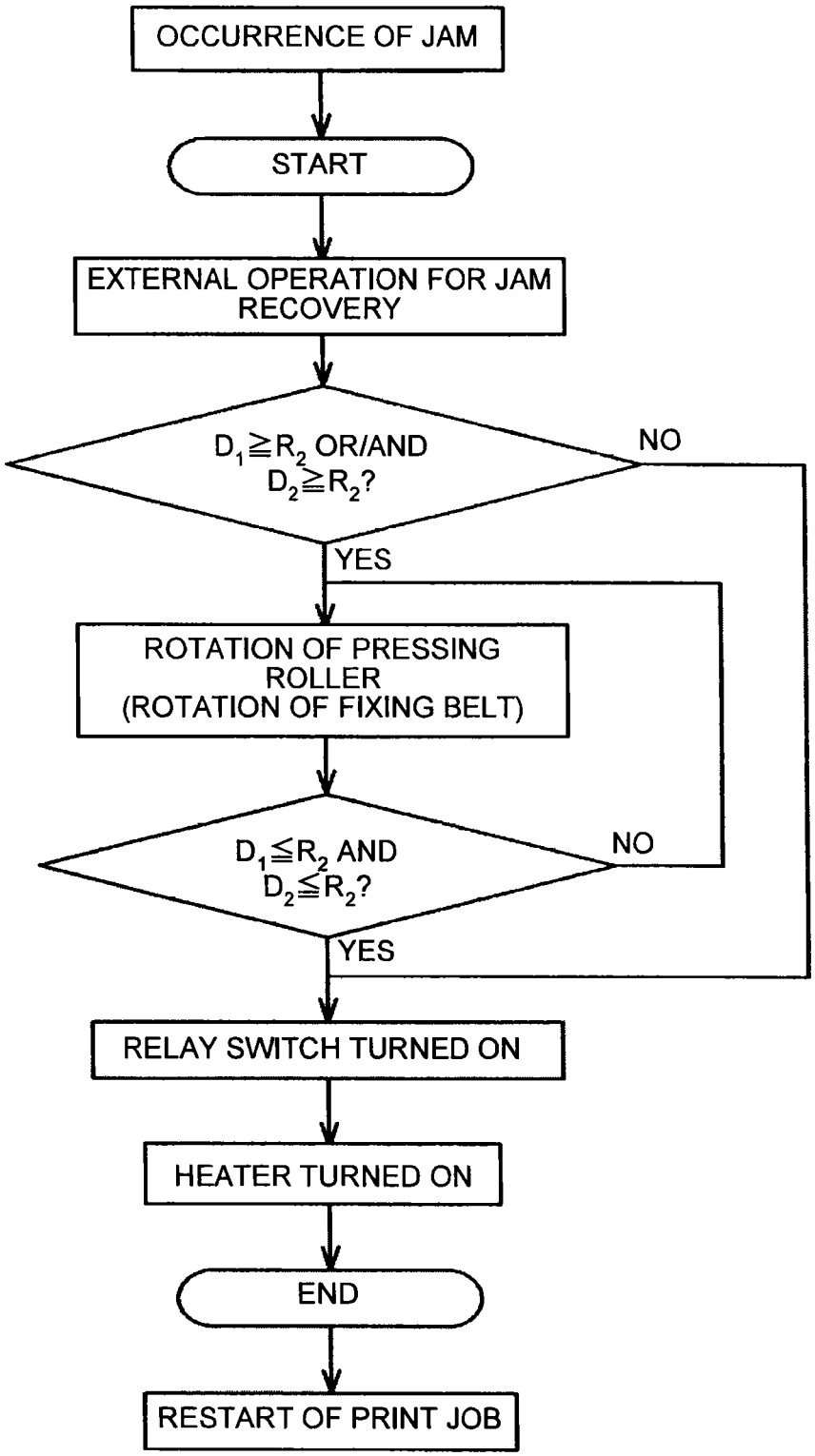
FIG. 7 is a diagram illustrating a flowchart of a jam recovery process.

FIG. 7 illustrates a flowchart of the jam recovery process performed by the relay control unit 54A as described above. When an external operation for recovery from a jam is performed, the relay control unit 54A determines whether the temperature information values $D_1$ and $D_2$ from the first thermopile 27A and the second thermopile 27B are equal to or larger than the reference value $R_2$. If $D_1 \geq R_2$ or/and $D_2 \geq R_2$, the relay control unit 54A keeps the relay switch 52 in the off state, and outputs the drive control signal $S_2$ to the drive control unit 60 to let the pressing roller 22 and the fixing belt 21 rotate (idle). Then, in this state, the relay control unit 54A determines whether the temperature information values $D_1$ and $D_2$ from the first thermopile 27A and the second thermopile 27B are equal to or less than the reference value $R_2$. When $D_1 \geq R_2$ and $D_2 \geq R_2$, the relay control unit 54A turns the relay switch 52 on to enable energization of the halogen heaters 23A and 23B and restart the print job. Meanwhile, when an external operation for recovery from a jam is performed, if relations $D_1 < R_2$ and $D_2 < R_2$ hold, the relay control unit 54A turns the relay switch 52 on without outputting the drive control signal $S_2$ to the drive control unit 60 (without idling the pressing roller 22 and the fixing belt 21), thereby to enable energization of the halogen heaters 23A and 23B and shift to the normal temperature control program in which temperature control is performed by the triac control unit 54B and the overheat protection circuit 54C, and then restart the print job.

The foregoing control is performed by the relay control unit 54A in the same manner at restart of the image forming device 1, at shift of the fixing device 20 from the off/sleep mode to the print mode, at recovery of the image forming device 1 from a sudden stop for reasons other than occurrence of a jam.

In the embodiment, the heat source for the fixing device 20 includes the first halogen heater 23A heating the central region of the fixing belt 21 and the second halogen heater 23B heating the both end regions of the fixing belt 21. Alternatively, the heat source may include only one halogen heater capable of heating the entire paper feed region of the fixing belt 21 to a predetermined temperature. Otherwise, the heat source may be a heat generating body other than a halogen heater.

The embodiment is also applicable to image forming devices including fixing devices of other types, for example, a fixing device of a belt type in which a fixing belt is extended between a fixing roller and a heating roller and a pressing roller is pressed and contacted with the fixing roller via the fixing belt, and a surf fixing device in which only a nip portion is locally heated by a ceramic heater or the like.

The fixing device according to the embodiment can be mounted in not only color laser printers as illustrated in FIG. 1 but also monochrome image forming devices, and other printers, photocopiers, and facsimiles, or MFPs of these devices, and the like. In addition, the embodiment can be modified in various manners without deviating from the gist of the invention.

According to the embodiment, when the fixing member stops rotation, if the temperature of the fixing member is equal to or more than the predetermined temperature, the control unit keeps the relay switch in the off state. Accordingly, even if the fixing member is excessively raised in temperature on a temporary basis, the fixing device is not brought into an abnormal stop by misjudgment of the overheat protection circuit or the like, and hence the fixing device can restart operation or continue a predetermined mode safely and appropriately. Specifically, when the relay switch is kept in the off state to stop energization of the heat source, even if the fixing member is excessively raised in temperature on a temporary basis, the fixing member does not reach a temperature which causes damage to the fixing member, and hence the image forming device does not need to be brought into an abnormal stop by activation of the overheat protection circuit or the like. Considering this respect, one of the embodiments is configured such that, if the fixing member is excessively raised in temperature on a temporary basis, the overheat protection circuit or the like is not activated to keep the relay switch in the off state and wait until the temperature of the fixing member is lowered to an appropriate temperature, and then the relay switch is turned on when the fixing member reaches the appropriate temperature to restart operation of the fixing device or continue a predetermined mode.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a rotatable fixing member that heats a recording medium on a side carrying an unfixed image;

a rotatable pressing member that is pressed and is contacted with the fixing member to form a nip portion between the pressing member and the fixing member;

a heater of the fixing member;

a relay switch provided in an energizing path for the heater;

a temperature detection sensor detecting a temperature of the fixing member; and a controller that controls energization of the heater according to the temperature detected by the temperature detection sensor, wherein the controller keeps the relay switch in an off state in a case that the temperature of the fixing member is equal to or more than a predetermined temperature when a predetermined external operation is performed under predetermined conditions in which the fixing member has stopped rotation and the relay switch is turned off.

2. The fixing device according to claim 1, wherein, if the temperature of the fixing member is equal to or more than a predetermined temperature, the controller keeps the relay in an off state and lets the fixing member rotate.

3. The fixing device according to claim 1, wherein the predetermined conditions are a state where an image forming device including the fixing device is powered off to stop activation, and the predetermined external operation is an operation for powering on and restarting the image forming device.

4. The fixing device according to claim 1, wherein the predetermined conditions are a state where the fixing device is in the off/sleep mode, and the predetermined external operation is an operation for instructing an image forming device including the fixing device to execute image forming.

5. The fixing device according to claim 1, wherein the predetermined conditions are a state where the image forming device including the fixing device is suddenly stopped, and the predetermined external operation is an operation for recovering the image forming device from the suddenly stopped state.

6. The fixing device according to claim 1, wherein the predetermined temperature is higher than a temperature of the fixing member in a paper feed mode of the fixing device.

7. The fixing device according to claim 1, wherein the fixing member is a flexible endless fixing belt, and the heater is arranged inside the fixing belt and directly heats the fixing belt with radiation heat.

8. The fixing device according to claim 7, wherein a pressure from the pressing member is supported by a supporting member arranged close to an inner peripheral surface of the fixing belt.

9. The fixing device according to claim 7, wherein the fixing belt is a thin-walled belt having a thickness of 1 mm or less, and the heater is a halogen heater.

10. The fixing device according to claim 1, wherein the relay switch is connected to the heater via a triac.

11. An image forming device comprising the fixing device according to claim 1.

12. The fixing device according to claim 1, wherein the controller turns on the relay switch after the temperature of the fixing member falls to below the predetermined temperature.

13. A method of controlling power to a heater for a fixing member in a fixing device, comprising the steps of:

controlling energization of the heater according to a temperature detected by a temperature detection sensor;

setting a relay switch in an energizing path for the heater in an off state when a predetermined external operation is performed under predetermined conditions in which the fixing member has stopped rotation; and thereafter keeping the relay switch in the off state in a case that the temperature of the fixing member is equal to or more than a predetermined temperature.

14. The method according to claim 13, further comprising a subsequent step of turning on the relay switch after the temperature of the fixing member falls to below the predetermined temperature.

15. An image forming device comprising:

a fixing device including a rotatable fixing member that heats a recording medium on a side carrying an unfixed image, a rotatable pressing member that is pressed and is contacted with the fixing member to form a nip portion between the pressing member and the fixing member, a heater of the fixing member, and a temperature detection sensor detecting a temperature of the fixing member;

a controller that controls energization of the heater according to the temperature detected by the temperature detection sensor; and a relay switch provided in an energizing path for the heater, wherein the controller keeps the relay switch in an off state in a case that the temperature of the fixing member is equal to or more than a predetermined temperature when a predetermined external operation is performed under predetermined conditions in which the fixing member has stopped rotation and the relay switch is turned off.

16. The image forming device according to claim 15, wherein, if the temperature of the fixing member is equal to or more than a predetermined temperature, the controller keeps the relay in an off state and lets the fixing member rotate.

17. The image forming device according to claim 15, wherein the predetermined conditions are a state where an image forming device including the fixing device is powered off to stop activation, and the predetermined external operation is an operation for powering on and restarting the image forming device.

18. The image forming device according to claim 15, wherein the predetermined conditions are a state where the fixing device is in the off/sleep mode, and the predetermined external operation is an operation for instructing an image forming device including the fixing device to execute image forming.

19. The image forming device according to claim 15, wherein the predetermined conditions are a state where the image forming device including the fixing device is suddenly stopped, and the predetermined external operation is an operation for recovering the image forming device from the suddenly stopped state.

20. The image forming device according to claim 15, wherein the predetermined temperature is higher than a temperature of the fixing member in a paper feed mode of the fixing device.

21. The image forming device according to claim 15, wherein the fixing member is a flexible endless fixing belt, and the heater is arranged inside the fixing belt and directly heats the fixing belt with radiation heat.

22. The fixing device according to claim 7, wherein the flexible endless fixing belt comprises a base material including stainless steel.

23. The image forming device according to claim 21, wherein the flexible endless fixing belt comprises a base material including stainless steel.

24. The fixing device according to claim 1, wherein the fixing member comprises a belt having a diameter of 30 mm or less.

25. The fixing device according to claim 7, wherein the fixing belt has a diameter of 30 mm or less.

26. The image forming device according to claim 15, wherein the fixing member comprises a belt having a diameter of 30 mm or less.

27. The image forming device according to claim 21, wherein the fixing belt has a diameter of 30 mm or less.

* * * * *